US007557793B2

(12) United States Patent
Cho et al.

(10) Patent No.: US 7,557,793 B2
(45) Date of Patent: Jul. 7, 2009

(54) GATE DRIVER AND DISPLAY DEVICE HAVING THE SAME

(75) Inventors: NamWook Cho, Gyeonggi-do (KR); SooYoung Yoon, Gyeonggi-do (KR); MinDoo Chun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 652 days.

(21) Appl. No.: 11/319,397

(22) Filed: Dec. 29, 2005

(65) Prior Publication Data

US 2006/0221041 A1 Oct. 5, 2006

(30) Foreign Application Priority Data

Mar. 31, 2005 (KR) ..... 10-2005-0027266

(51) Int. Cl.
*G09G 3/36* (2006.01)

(52) U.S. Cl. ..... 345/100; 345/98; 377/64

(58) Field of Classification Search ..... 345/98–100; 377/64, 74

See application file for complete search history.

(56) References Cited

U.S. PATENT DOCUMENTS

| | | | | |
|---|---|---|---|---|
| 5,434,899 | A * | 7/1995 | Huq et al. | 377/78 |
| 6,091,393 | A * | 7/2000 | Park | 345/100 |
| 6,693,617 | B2 * | 2/2004 | Sasaki et al. | 345/98 |
| 6,829,322 | B2 * | 12/2004 | Shih et al. | 377/78 |
| 2003/0002615 | A1 * | 1/2003 | Morosawa et al. | 377/64 |
| 2006/0187175 | A1 * | 8/2006 | Lo et al. | 345/100 |
| 2006/0227093 | A1 * | 10/2006 | Jang et al. | 345/100 |

* cited by examiner

*Primary Examiner*—Amare Mengistu
*Assistant Examiner*—Hong Zhou
(74) *Attorney, Agent, or Firm*—Holland & Knight LLP

(57) ABSTRACT

A gate driver includes a plurality of shift registers connected in cascade to each other and driven by a plurality of multiphase clocks, respectively, wherein the next shift register to which one of the plurality of multiphase clocks is applied is reset using an output signal outputted from the previous shift register in response to the one of the plurality of multiphase clocks.

16 Claims, 10 Drawing Sheets

GATE DRIVER AND DISPLAY DEVICE HAVING THE SAME

This application claims the benefit of Korean Patent Application No. P2005-027266 filed in Korea on Mar. 31, 2005, which is hereby incorporated by reference in its entirety.

BACKGROUND OF THE INVENTION

1. Field of the Invention

The present invention relates to a gate driver, and more particularly, to a gate driver capable of outputting a reliable output signal and a display device having the gate driver.

2. Description of the Related Art

A display device for displaying an image by controlling pixels arranged in a matrix has been widely used. A liquid crystal display device (LCD) and an organic light emitting diode device (OLED) are examples of such display devices.

Such display devices include a display panel having pixels arranged in a matrix, a gate driver for scanning pixels line by line, and a data driver for supplying an image data. Recently, a display device having a gate driver and/or a data driver embedded on the display panel has developed to achieve a low manufacturing cost, simplify the manufacturing process, and be light and slim.

When manufacturing the display panel, the gate driver and/or the data driver are/is manufactured concurrently. That is, a plurality of thin film transistors (TFTs) are provided to control each of the pixels in the display panel, and the gate driver and/or the data driver can be manufactured through the same semiconductor process as the TFT. Each of the drivers includes a plurality of shift registers for outputting output signals. For example, when the display panel has ten gate lines, ten shift registers are provided to supply their output signals to the ten gate lines, respectively.

FIG. 1 is a block diagram of a related art gate driver. Referring to FIG. 1, the related art gate driver includes a plurality of shift registers SRC1 through SRC[N+1]. The shift registers include N shift registers SRC1 through SRC[N] corresponding to N gate lines, and a dummy shift register SRC[N+1]. The shift registers SRC1 through SRC[N+1] are connected in cascade with each other. That is, an output terminal OUT of each shift register is connected to a set terminal SET of the next shift register. Each of the shift registers SRC1 through SRC[N] other than the dummy shift register SRC[N+1] is reset by the output signal of its next shift register. The output of the dummy shift register SRC[N+1] is used to reset the previous shift register SRC[N].

The first shift register SRC1 is set by a pulse start signal STV. The pulse start signal is a pulse synchronized with a vertical synch signal Vsync. Each of the shift registers SRC2 through SRC[N+1] is set by an output signal from the preceding shift register. When there are N gate lines, output signals GOUT1 through GOUT[N] of the N shift registers are connected to the corresponding gate lines (not shown). The output signal GOUT[N+1] of the dummy shift register SRC [N+1] is not connected to any gate line.

A first clock CKV is supplied to the odd-numbered shift registers SRC1,SRC3, . . . , and a second clock CKVB is supplied to the even-numbered shift registers SRC2, SRC4, . . . . Here, a phase of the first clock CKV is opposite to that of the second clock CKVB. The first clock CKV is simultaneously applied to the odd-numbered shift registers SRC1, SRC3, . . . , and the second clock CKVB is simultaneously applied to the even-numbered shift registers SRC2, SRC4,. . . .

The pulse start signal STV is applied to the first shift register SRC1 when the second clock CKVB is high. The shift registers SRC1 through SRC[N] output the respective output signals GOUT1 through GOUT[N], respectively, in synchronization with the first clock CKV or the second clock CKVB.

Accordingly, each of the shift registers SRC1 through SRC [N] is set by the output signal of its previous shift register and outputs the output signal in synchronization with the first or second clocks CKV or CKVB, and then is reset by the output signal of its next shift register. However, since there is no shift register next to the dummy shift register SRC[N+1], the dummy shift register SRC[N+1] is reset by its own output signal GOUT[N+1].

FIG. 2 is a circuit diagram of the related art shift register of FIG. 1. FIG. 3 is a waveform diagram of driving signals for driving the related art shift register of FIG. 2. Since the shift registers illustrated in FIG. 1 have the identical structure to one another, only the first shift register SRC1 will be described for convenience.

Referring to FIGS. 2 and 3, when the pulse start signal STV is high, the first clock CKV and the second clock CKVB are low and high, respectively. Also, the first clock CKV and the second clock CKVB are at a high state at each clock period. The first shift register SRC1 is set by a high state of the pulse start signal STV during a high state of the second clock CKVB. That is, when the pulse start signal STV is applied, a Q node is charged to a voltage of the pulse start signal STV. A first transistor M1 is turned on by the charged Q node. Then, a QB node is discharged by a voltage difference (VDD−VSS) between a first power supply voltage and a second power supply voltage. Consequently, a low voltage of the QB node is maintained by a ratio of a resistance R1 of a first transistor M1 to a resistance R6 of a sixth transistor M6.

During a high state of the first clock CKV, a first output signal GOUT1 is outputted in response to the first clock CKV. That is, when the first clock CKV is applied to the second transistor M2, a bootstrapping is caused by a drain-gate capacitance in a second transistor M2, and thus the Q node is charged with a voltage higher than that of the charged pulse start signal STV. Accordingly, the second transistor M2 is turned on and thus the first clock CKV is outputted as the first output signal GOUT1.

During the next period of the second clock CKVB, the first shift register SRC1 is reset by the second output signal GOUT2 of its next shift register SRC2. That is, a fifth transistor M5 is turned on by the second output signal GOUT2 of the shift register SRC2, and the Q node is discharged by a first power supply voltage VSS passing through the fifth transistor M5. Additionally, the first transistor M1 is turned off by the discharged Q node, and the QB node is charged with the second supply voltage VDD passing through the sixth transistor M6, so that third and fourth transistors M3 and M4 are turned on by the charged QB node. Accordingly, the Q node is easily discharged by the first power supply voltage VSS passing through the turned-on fourth transistor M4. In this case, most of the output signal GOUT1 is discharged through a source-drain path of the second transistor M2, and the remaining output signal GOUT1 is discharged through the first power supply voltage VSS by the turned-on third transistor M3. However, an undesired output signal may be generated from each of the shift registers SRC1 through SRC[N] in the related art gate driver.

FIG. 4 is a graph illustrating a plurality of undesired output signals outputted in the related art gate driver. As illustrated in FIG. 4, when an Nth output signal GOUT[N] is outputted from the Nth shift register SRC[N] by the second clock CKVB, second and fifth output signals GOUT2 and GOUT4 are also outputted respectively from even-numbered shift registers SRC2 and SRC4 to which the second clock CKVB is applied. That is, in addition to a desired output signal, a plurality of undesired output signals may be outputted during one clock period.

Specifically, the shift registers SRC1 through SRC[N] output the corresponding output signals GOUT1 through GOUT [N] once per frame period. For example, the fourth shift register SRC4 outputs the fourth output signal GOUT4 during a period of the second clock CKVB period, but does not output the output signal during the remaining part (90%) of the frame period. For this purpose, the third transistor M3 of the fourth shift register SRC4 must be turned on and thus the QB node connected to the third transistor M3 always maintains a high state during the remaining period. When this operation is repeated for each frame, the third and fourth transistors M3 and M4 are degraded. Accordingly, the threshold voltages of the third and fourth transistors M3 and M4 are shifted and thus the transistors M3 and M4 cannot be easily turned off. In the worst case, the fourth transistor M4 is not turned off and thus the Q node is not reset. In this case, the output signal is outputted at an undesired time by the first or second clock CKV or CKVB.

Taking into consideration all the shift registers SRC1 through SRC[N], when the Nth output signal GOUT[N] is outputted from the Nth shift register SRC[N] by the second clock CKVB, the second and fifth output signals GOUT2 and GOUT4 are also outputted respectively from even-numbered shift registers SRC2 and SRC4 to which the second clock CKVB is applied. This causes the device to malfunction, causing for example screen flickering, thus greatly degrading the reliability of the display.

SUMMARY OF THE INVENTION

Accordingly, the present invention is directed to a gate driver and a display device having the same that substantially obviate one or more problems due to limitations disadvantages of the related art.

An object of the present invention is to provide a reliable gate driver, and a device having the reliable gate driver.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a gate driver includes a plurality of shift registers connected in cascade to each other and driven by a plurality of multiphase clocks, respectively, wherein the next shift register to which one of the plurality of multiphase clocks is applied is reset using an output signal outputted from the previous shift register in response to the one of the plurality of multiphase clocks.

In another aspect, a display device includes a display panel in which pixels defined by gate lines and data lines are arranged in a matrix; a data driver supplying image data to the data lines; and a gate driver supplying corresponding output signals to the gate lines, the gate driver including a plurality of shift registers connected in cascade to each other and driven by a plurality of multiphase clocks, respectively, wherein the next shift register to which one of the plurality of multiphase clocks is applied is reset using an output signal outputted from the previous shift register in response to the one of the plurality of multiphase clocks.

In another aspect, a method for driving gate lines in a display panel includes sequentially outputting a plurality of output signals, including first, second, and third output signals through corresponding first, second and third shift registers, respectively; setting the second shift register concurrently with outputting the first output signal; and setting the third shift register and resetting the first shift register concurrently with outputting the second output signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
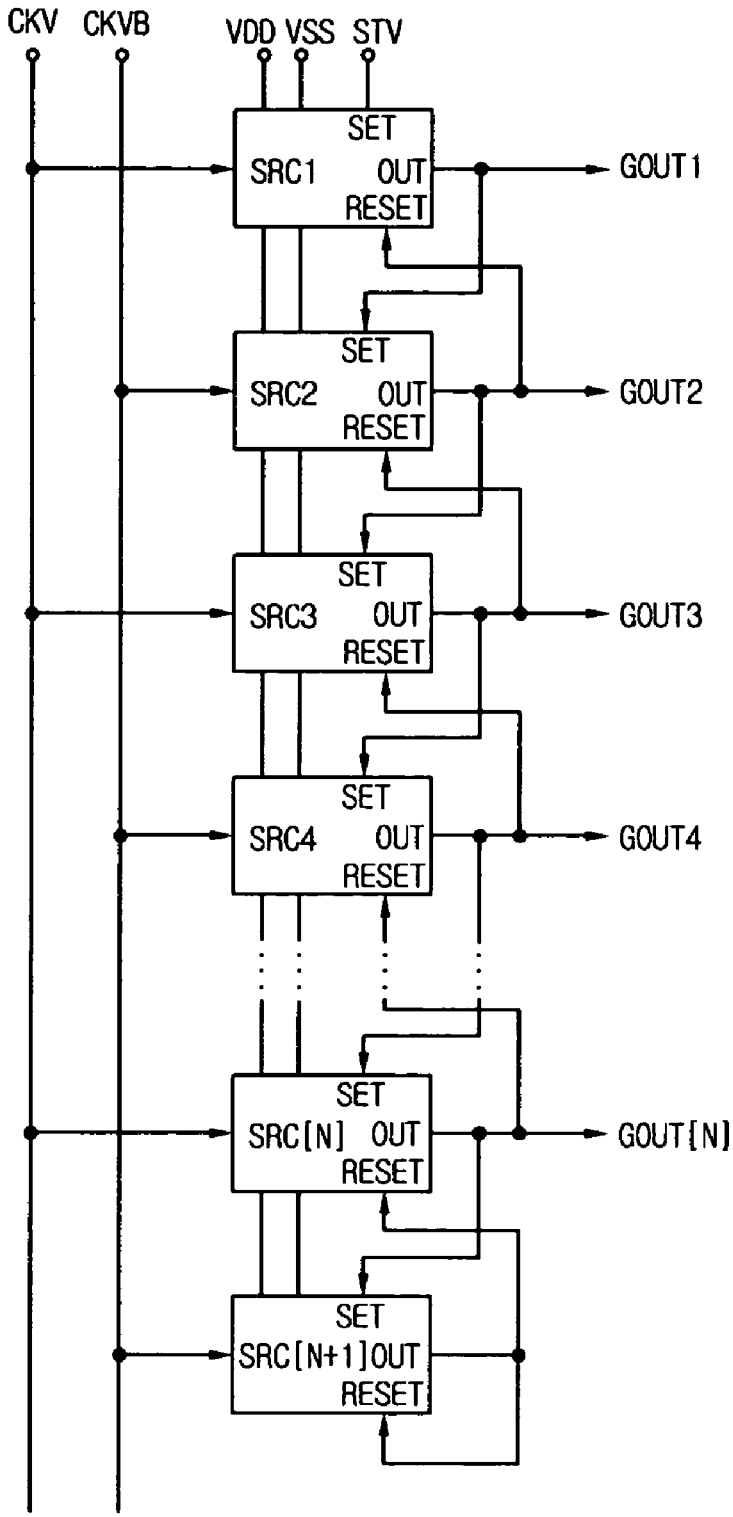
Fig.1 (Related Art)
FIG. 1 is a block diagram of a related art gate driver.
Figure 2:
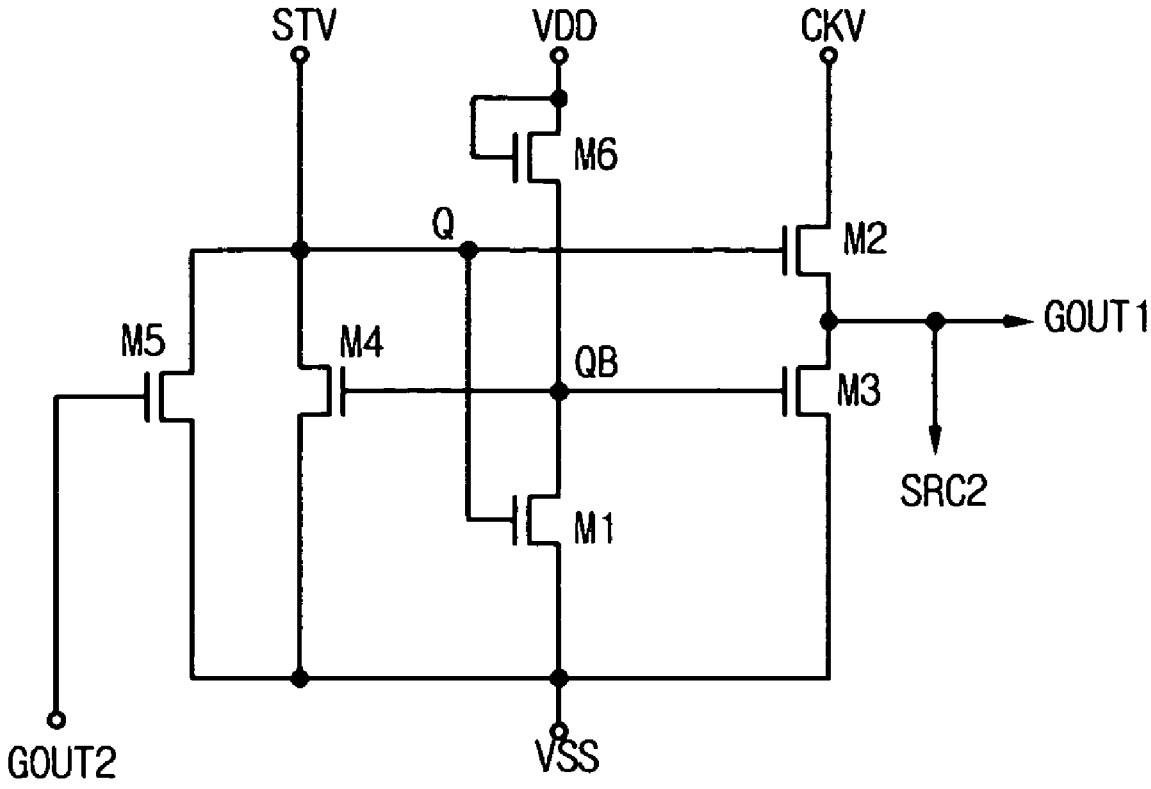
Fig.2 (Related Art)
FIG. 2 is a circuit diagram of the related art shift register of FIG. 1.
Figure 3:
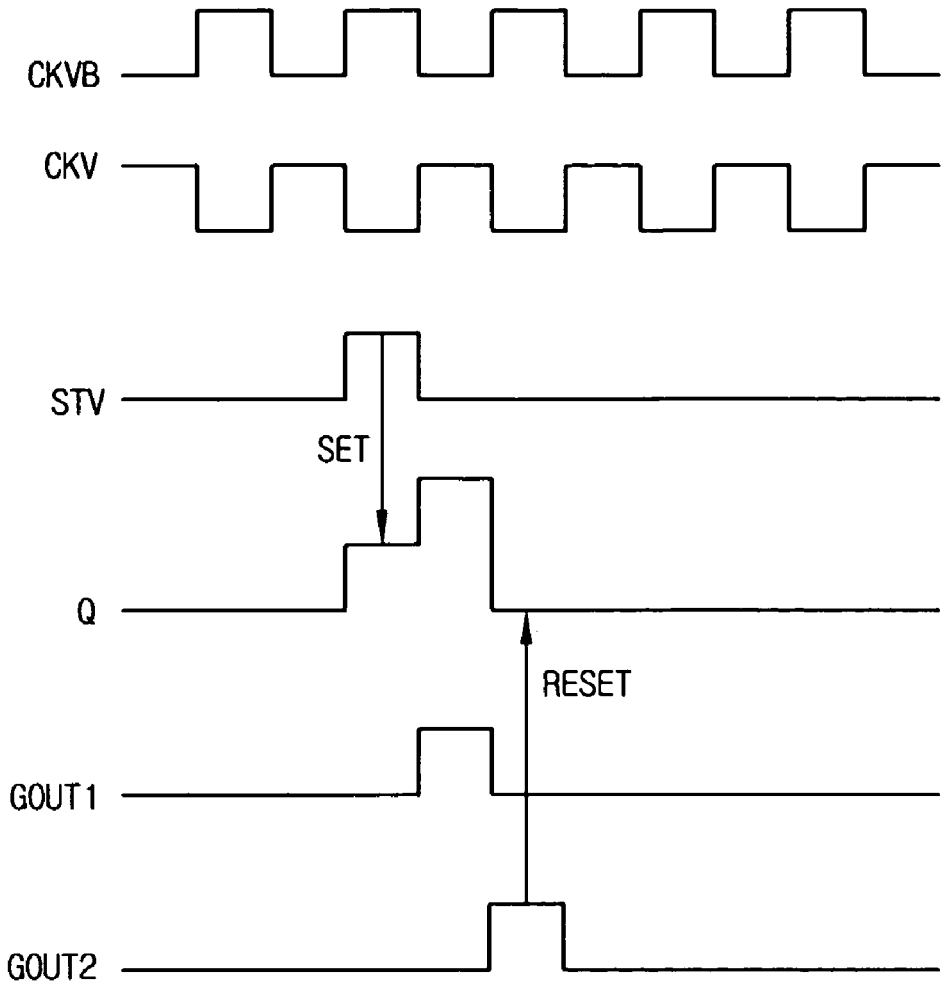
Fig.3 (Related Art)
FIG. 3 is a waveform diagram of driving signals for driving the related art shift register of FIG. 2.
Figure 4:
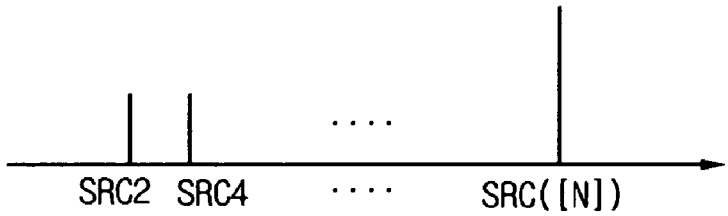
Fig.4 (Related Art)
FIG. 4 is a graph illustrating a plurality of undesired output signals outputted in the related art gate driver.
Figure 5:
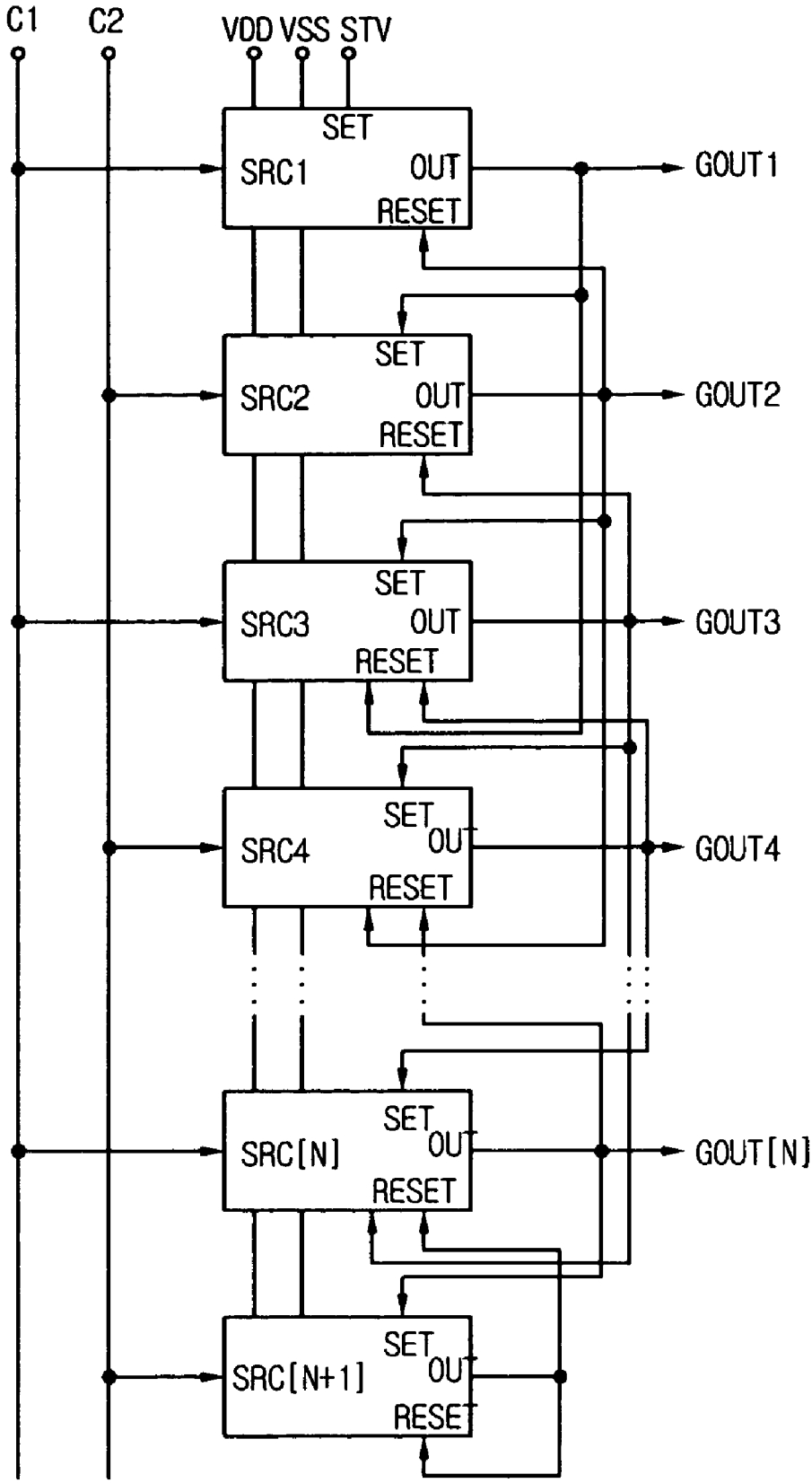
FIG. 5 is a block diagram of an exemplary gate driver according to a first embodiment of the present invention.

FIG. 5 is a block diagram of an exemplary gate driver according to a first embodiment of the present invention. Referring to FIG. 5, the gate driver includes N shift registers SRC1 through SRC[N] and a dummy shift register SRC[N+1] for resetting the Nth shift register SRC[N]. Each of the shift registers SRC1 through SRC[N] is connected to a multiphase clock, for example, one of a first two-phase clock C1 and a second two-phase clock C2. The two-phase clocks C1 and C2 provide two-phase clock signals for driving the shift registers SRC1 through SRC[N]. For example, the first clock C1 can be commonly connected to and simultaneously applied to the odd-numbered shift registers SRC1, SRC3, . . . . The second clock C2 can be commonly connected to and simultaneously applied to the even-numbered shift registers SRC2, SRC4, . . . .

The shift registers SRC1 through SRC[N] output corresponding output signals GOUT1 through GOUT[N]. In an embodiment, the output signal GOUT2 of the shift register SRC2 is inputted into a set terminal SET of the next shift register SRC3, a reset terminal RESET of the second next shift register SRC4, and a reset RESET terminal of the previous shift register SCR1. Accordingly, the output signal GOUT2 of the shift register SRC2 sets the first next shift register SRC3, and resets the second next shift register SRC4 and the previous shift register SRC1. Thus, the output signal of each shift register is inputted into a set terminal of the first next shift register, a reset terminal of the second next shift register, and a reset terminal of the previous shift register. Accordingly, the output signal of the current shift register sets the first next shift register, and resets the second next shift register and the previous shift register.

A first power supply voltage VSS and a second power supply voltage VDD are supplied to each of the shift registers SRC1 through SRC[N+1]. When each shift register SRC1 through SRC[N+1] is set, a Q node (not shown) connected to its output terminal OUT is charged with the second power supply voltage VDD. On the contrary, when the shift register SRC1 to SRC[N+1] is reset, the Q node is discharged by the first power supply voltage VSS.

The first and second clocks C1 and C2 serve as two-phase clocks. The first and second clocks C1 and C2 are alternately applied to the shift registers C1 through SRC[N+1]. For example, the first clock C1 can be applied to the first shift register SRC1, the third shift register SRC3, and so on. The second clock C2 can be applied to the second shift register SRC2, the fourth shift register SRC4, and so on. Accordingly, an output signal of the Mth shift register (M=N−2) is inputted into and resets the (M+2)th shift register.

Figure 6:
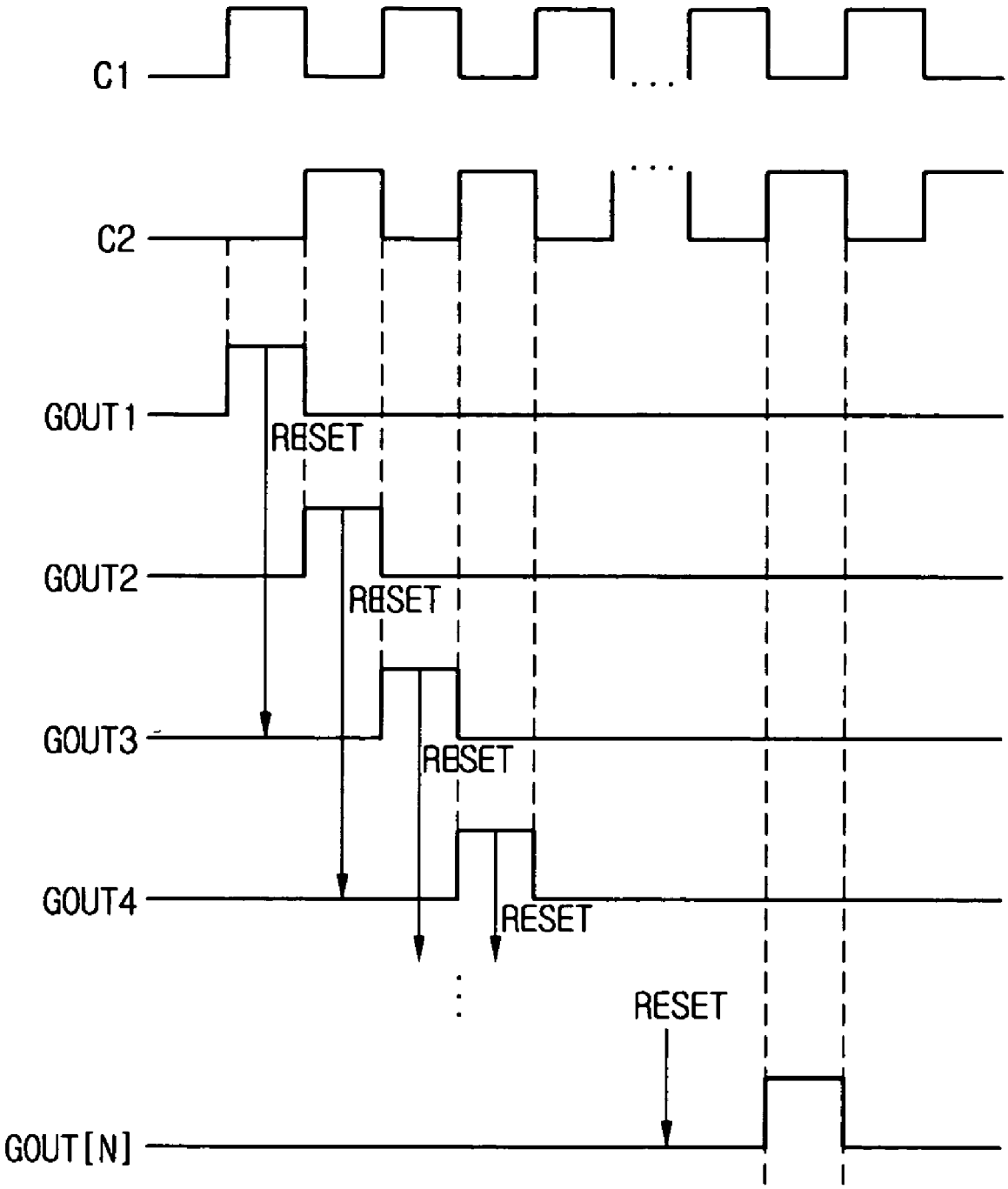
FIG. 6 is a waveform diagram of exemplary driving signals for the gate driver of FIG. 5.

FIG. 6 is a waveform diagram of exemplary driving signals for the gate driver of FIG. 5. Referring to FIG. 6, the first shift register SRC1 is enabled by the first clock C1 to output an output signal GOUT1, which is inputted into and resets the third shift register SRC3, to which the first clock C1 is also applied. In this case, the Q node (not shown) electrically connected to an output terminal OUT of the third shift register SRC3 is discharged into the first power supply voltage VSS. Similarly, the second shift register SRC2 is activated by the second clock C2 to an output signal GOUT2, which is inputted into and resets the fourth shift register SRC4, to which the second clock C2 is also applied. In this case, the Q node (not shown) electrically connected to an output terminal OUT of the fourth shift register SRC4 is discharged into the first power supply voltage VSS.

In an embodiment, a current shift register is activated by the first clock C1 to output an output signal, which is inputted into and resets the second of the following shift registers, to which the first clock C1 is also applied. Similarly, the first of the following shift registers is activated by the second clock C1 to output an output signal, which is inputted into and resets the third of the following shift registers, to which the second clock C2 is also applied. Accordingly, the first, second and third of the following shift registers do not output any output signal at the time when the current shift register outputs an output signal. Thus, the (M+2)th shift register is reset by the output signal of the Mth shift register. Moreover, no output signal is outputted from the previous shift register at the time when an output signal is outputted from the current shift register. Therefore, even when a shift register is degraded due to the long-time operation of the gate driver, a desired output signal can be generated only from a corresponding shift register, thereby enhancing the reliability of the gate driver.

Figure 7:
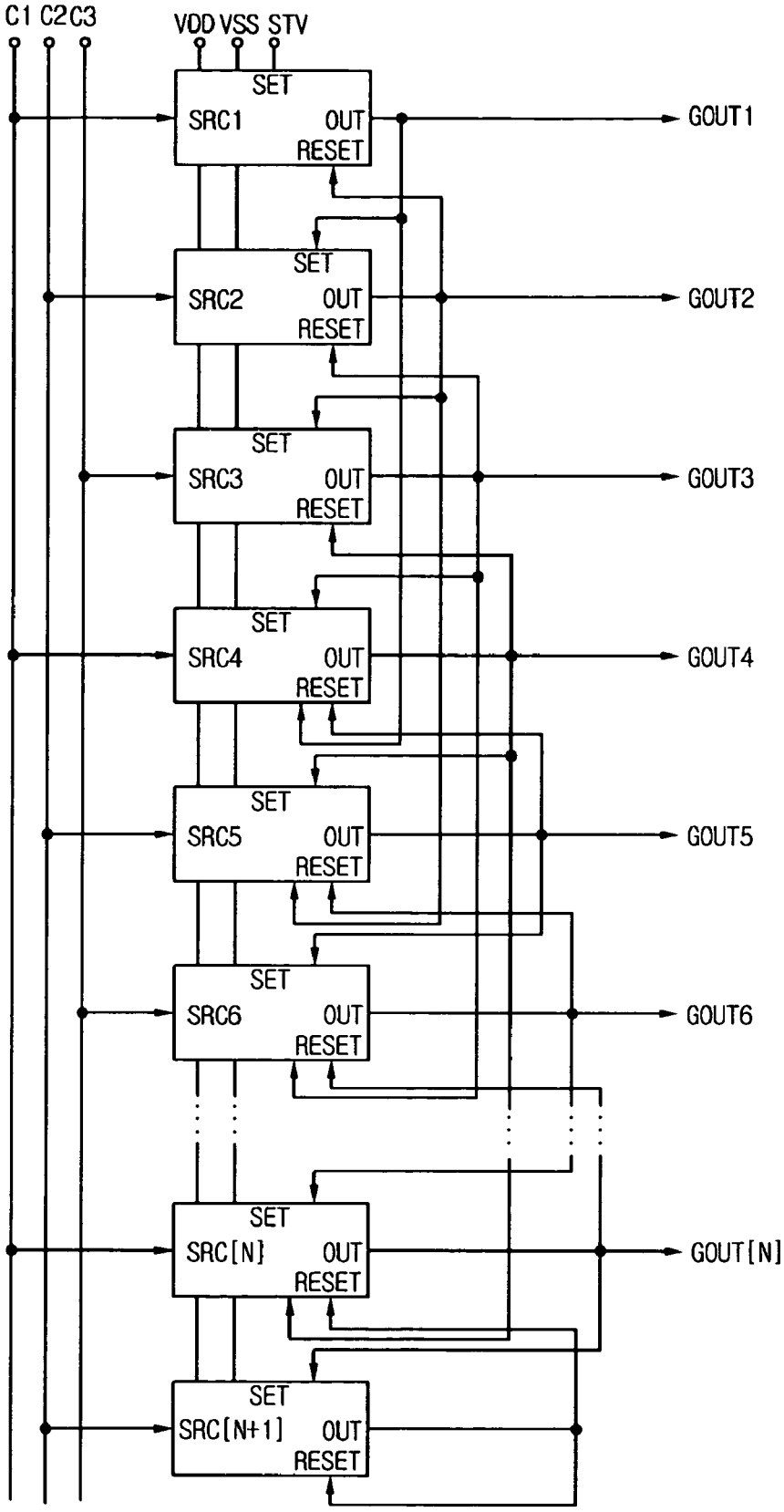
FIG. 7 is a block diagram of an exemplary gate driver according to a second embodiment of the present invention.

FIG. 7 is a block diagram of an exemplary gate driver according to a second embodiment of the present invention. In describing the second embodiment, a description of parts that are similar to corresponding parts already described with regard to the first embodiment will be omitted for conciseness. Referring to FIG. 7, each of the shift registers SRC1 through SRC[N+1] is connected to one of three-phase clocks including a first clock C1, a second clock C2 and a third clock C3. That is, the first clock C1 is commonly connected to and simultaneously applied to the first shift register SRC1, the fourth shift register SRC4, and so on. The second clock C2 is commonly connected to and simultaneously applied to the second shift register SRC2, the fifth shift register SRC5, and so on. The third clock C3 is commonly connected to and simultaneously applied to the third shift register SRC3, the sixth shift register SRC6, and so on.

The shift registers SRC1 through SRC[N] output corresponding output signals GOUT1 through GOUT[N], respectively. The first output signal GOUT1 is outputted from the first shift register SRC1 activated by the first clock signal C1. The first output signal GOUT1 is inputted into a set terminal of the second shift register SRC2 and a reset terminal of the fourth shift register SRC4. Thus, the first output signal GOUT1 can set the second shift register SRC2 and reset the fourth shift register SRC4.

The second output signal GOUT2 is outputted from the second shift register SRC2 enabled by the second clock signal C2. The second output signal GOUT2 is inputted into a set terminal of the third shift register SRC3, a reset terminal of the fifth shift register SRC5, and a reset terminal of the first shift register SRC1. Thus, the second output signal GOUT2 can set the third shift register SRC3 and reset the fifth shift register SRC5 and the first shift register SRC1.

The third output signal GOUT3 is outputted from the third shift register SRC3 enabled by the third clock signal C3. The third output signal GOUT3 is inputted into a set terminal of the fourth shift register SRC4, a reset terminal of the sixth shift register SRC6, and a reset terminal of the second register SRC2. Thus, the third output signal GOUT3 can set the fourth shift register SRC4 and reset the sixth shift register SRC6 and the second shift register SRC2. This operation is repeated up to the Nth shift register SRC[N].

The first, second and third clocks C1, C2 and C3 serving as three-phase clocks are alternately applied to the shift registers SCR1 through SCR[N+1]. Accordingly, an output signal of the Mth shift register (M=N−2) is inputted into and resets the (M+3)th shift register.

Figure 8:
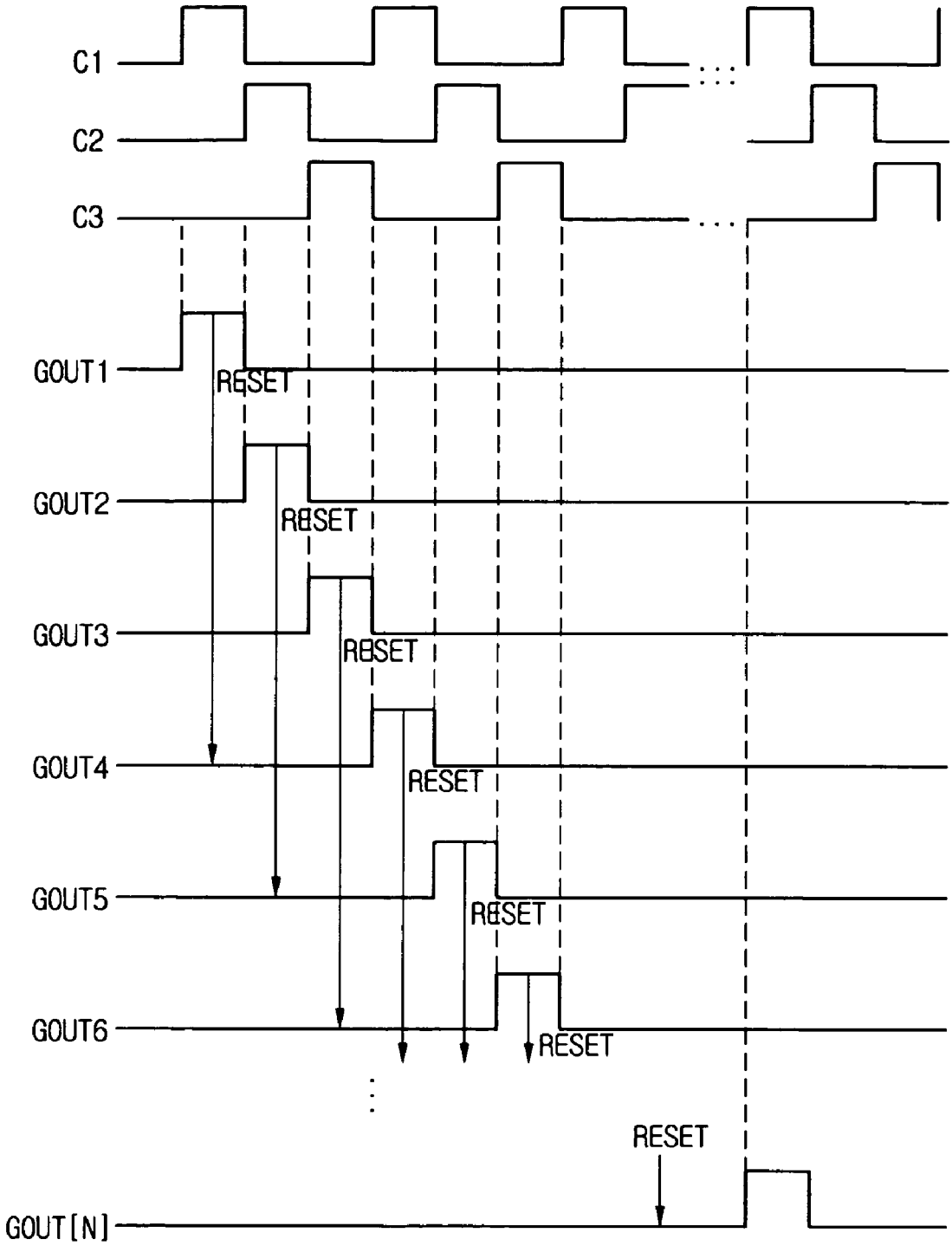
FIG. 8 is a waveform diagram of exemplary driving signals for the gate driver of FIG. 7.

FIG. 8 is a waveform diagram of exemplary driving signals for the gate driver of FIG. 7. Referring to FIG. 8, the first shift register SRC1 enabled by the first clock C1 outputs an output signal GOUT1, which is inputted into and resets the fourth shift register SRC4, to which the first clock C1 is also applied. In this case, the Q node (not shown) electrically connected to an output terminal OUT of the fourth shift register SRC4 is discharged into the first power supply voltage VSS.

Similarly, the second shift register SRC2 activated by the second clock C2 outputs an output signal GOUT2, which is inputted into and resets the fifth shift register SRC5, to which the second clock C2 is also applied. In this case, the Q node (not shown) electrically connected to an output terminal OUT of the fifth shift register SRC5 is discharged into the first power supply voltage VSS.

Also, the third shift register SRC3 enabled by the third clock C3 outputs an output signal GOUT3, which is inputted into and resets the sixth shift register SRC6 to which the third clock C3 is also applied. In this case, the Q node (not shown) electrically connected to an output terminal OUT of the six shift register SRC6 is discharged into the first power supply voltage VSS. By the above operation, the (M+3)th shift register can be reset by the output signal of the Mth shift register.

Accordingly, in case of three-phase clocks, no output signal is outputted from the previous shift register at the time when an output signal is outputted from the current shift register. Therefore, even when each shift register is degraded due to the long-time operation of the gate driver, a desired output signal can be generated only from a corresponding shift register, thereby enhancing the reliability of the gate driver.

Figure 9:
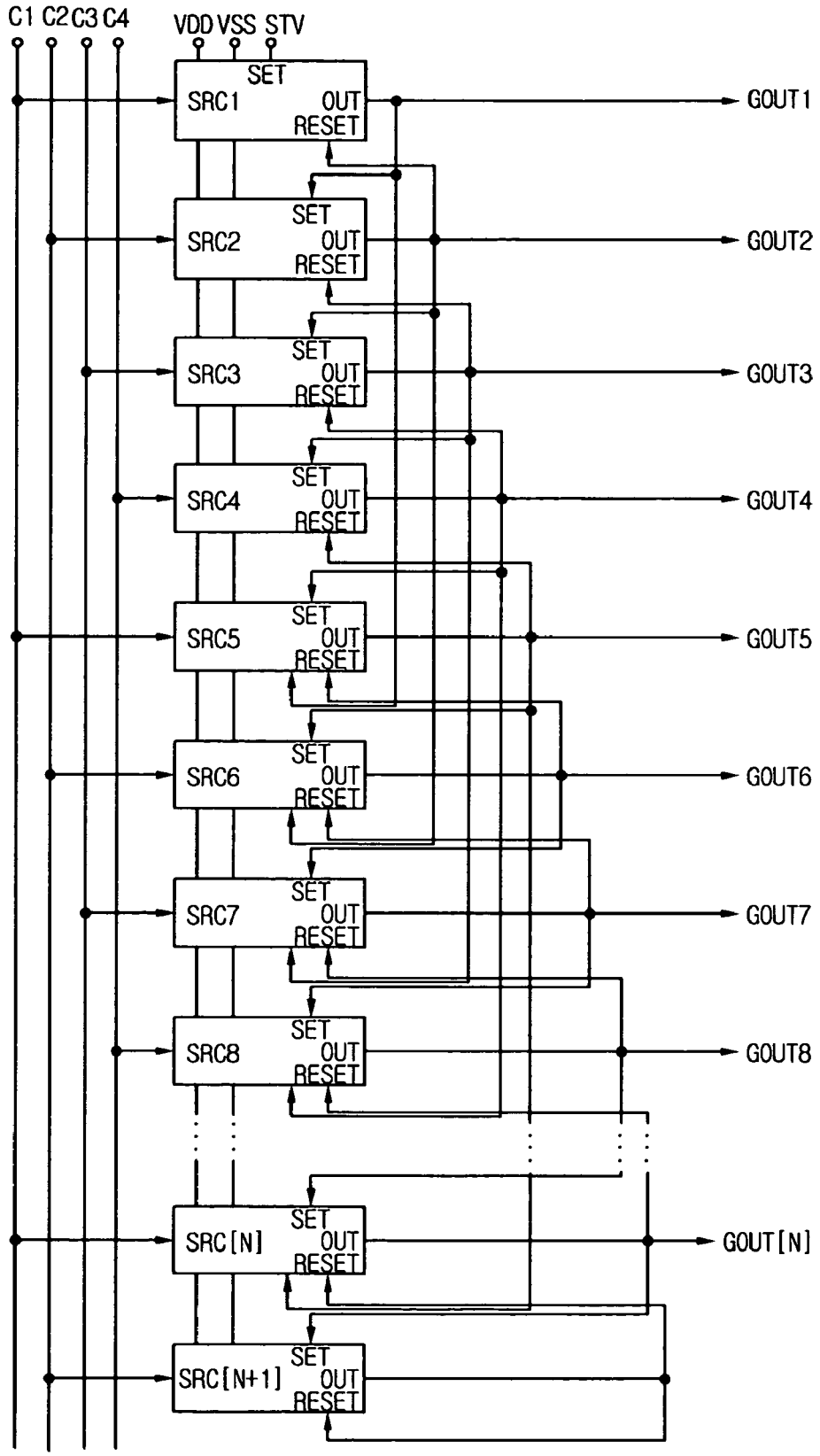
FIG. 9 is a block diagram of an exemplary gate driver according to a third embodiment of the present invention.

FIG. 9 is a block diagram of an exemplary gate driver according to a third embodiment of the present invention. In describing the third embodiment, a description of parts that are similar to corresponding parts already described with regard to the first and/or second embodiments will be omitted for conciseness. Referring to FIG. 9, each of the shift registers SRC1 through SRC[N+1] is connected to one of a plurality of four-phase clocks including a first clock C1, a second clock C2, a third clock C3 and fourth clock C4. That is, the first clock C1 is commonly connected to and simultaneously applied to the first shift register SRC1, the fifth shift register SRC5, and so on. The second clock C3 is commonly connected to and simultaneously applied to the second shift register SRC2, the sixth shift register SRC6, and so on. The third clock C3 is commonly connected to and simultaneously applied to the third shift register SRC3, the seven shift register SRC7, and so on. The fourth clock C4 is commonly connected to and simultaneously applied to the fourth shift register SRC4, the eighth shift register SRC8, and so on. The shift registers SRC1 through SRC[N] output corresponding output signals GOUT1 through GOUT[N].

The first output signal GOUT1 is outputted from the first shift register SRC1 activated by the first clock signal C1. The first output signal GOUT1 is inputted into a set terminal of the second shift register SRC2 and a reset terminal of the fifth shift register SRC5. Thus, the first output signal GOUT1 can set the second shift register SRC2 and reset the fifth shift register SRC5.

The second output signal GOUT2 is outputted from the second shift register SRC2 enabled by the second clock signal C2. The second output signal GOUT2 is inputted into a set terminal of the third shift register SRC3, a reset terminal of the sixth shift register SRC6, and a reset terminal of the first shift register SRC1. Thus, the second output signal GOUT2 can set the third shift register SRC3 and reset the sixth shift register SRC6 and the first shift register SRC1.

The third output signal GOUT3 is outputted from the third shift register SRC3 activated by the third clock signal C3. The third output signal GOUT3 is inputted into a set terminal of the fourth shift register SRC4, a reset terminal of the seventh shift register SRC7, and a reset terminal of the second register SRC2. Thus, the third output signal GOUT3 can set the fourth shift register SRC4 and reset the seventh shift register SRC7 and the second shift register SRC2.

The fourth output signal GOUT4 is outputted from the fourth shift register SRC4 enabled by the fourth clock signal C4. The fourth output signal GOUT4 is inputted into a set terminal of the fifth shift register SRC5, a reset terminal of the eighth shift register SRC8, and a reset terminal of the third register SRC3. Thus, the fourth output signal GOUT4 can set the fifth shift register SRC5 and reset the eighth shift register SRC3 and the third shift register SRC3. This operation is repeated up to the Nth shift register SRC[N].

The first, second, third and fourth clocks C1, C2, C3 and C4 serving as four-phase clocks are alternately applied to the shift registers SCR1 through SCR[N+1]. Accordingly, an output signal of the Mth shift register (M=N−4) is inputted into and resets the (M+4)th shift register.

Figure 10:
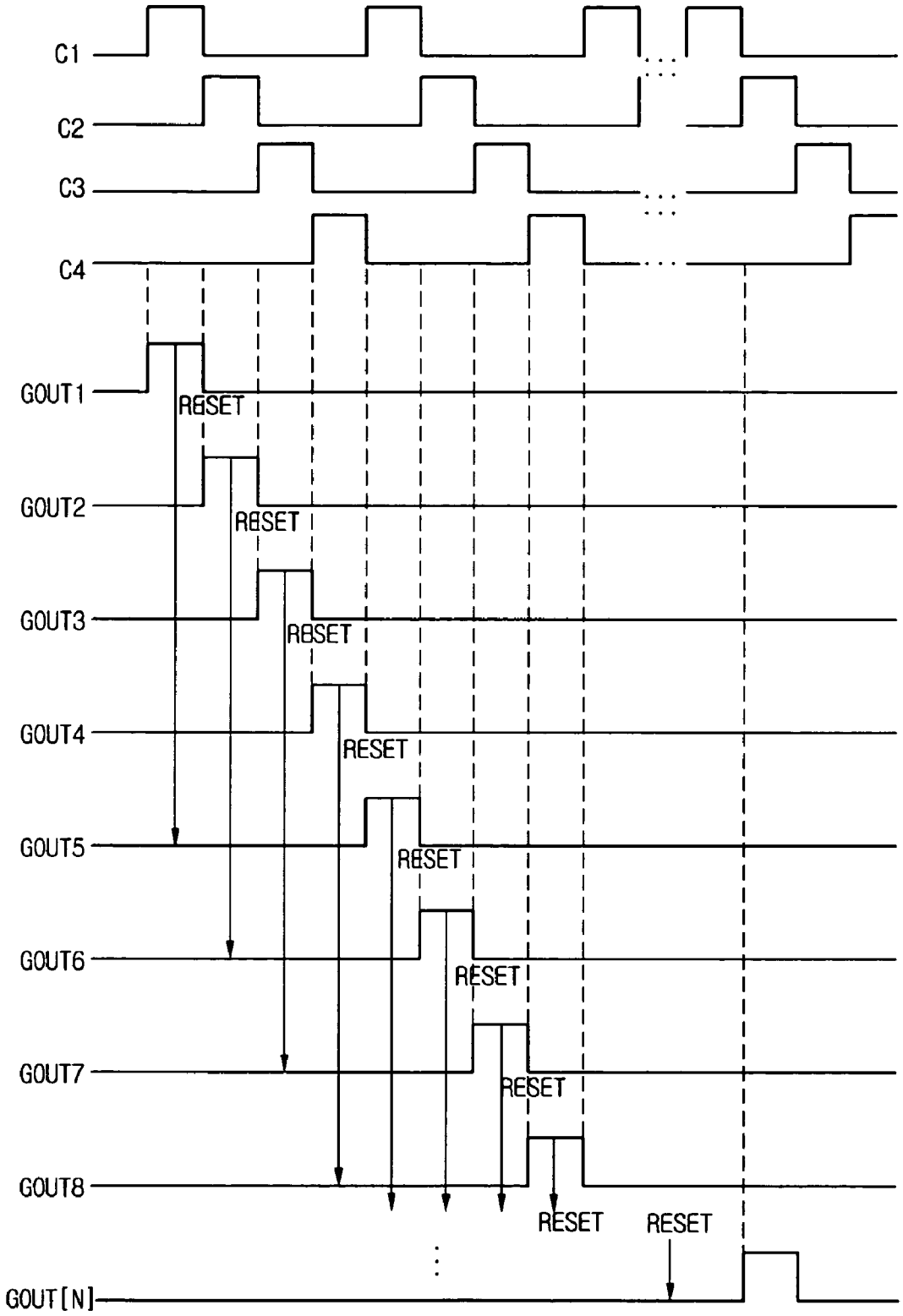
FIG. 10 is a waveform diagram of exemplary driving signals for the gate driver of FIG. 9.

FIG. 10 is a waveform diagram of exemplary driving signals for the gate driver of FIG. 9. As illustrated in FIG. 10, an output signal GOUT1 outputted from the first shift register SRC1, which is enabled by the first clock C1, is inputted into and resets the fifth shift register SRC5, to which the first clock C1 is also applied. In this case, the Q node (not shown) electrically connected to an output terminal OUT of the fifth shift register SRC5 is discharged into the first power supply voltage VSS.

An output signal GOUT2 outputted from the second shift register SRC2, which is enabled by the second clock C2, is inputted into and resets the sixth shift register SRC6, to which the second clock C2 is also applied. In this case, the Q node (not shown) electrically connected to an output terminal OUT of the sixth shift register SRC6 is discharged into the first power supply voltage VSS.

An output signal GOUT3 outputted from the third shift register SRC3, which is enabled by the third clock C3, is inputted into and resets the seventh shift register SRC7, to which the third clock C3 is also applied. In this case, the Q node (not shown) connected to an output terminal OUT of the seventh shift register SRC7 is discharged to the first power supply voltage VSS.

An output signal GOUT4 outputted from the fourth shift register SRC4, which is activated by the fourth clock C4, is inputted into and resets the eighth shift register SRC8 to which the fourth clock C4 is also applied. In this case, the Q node (not shown) connected to an output terminal OUT of the eighth shift register SRC8 is discharged to the first power supply voltage VSS. Thus, the (M+4)th shift register can be reset by the output signal of the Mth shift register.

Accordingly, when the multiphase clocks are four-phase clocks, no output signal is outputted from the previous shift register at the time when an output signal is outputted from the current shift register. Therefore, even when each shift register is degraded due to the long-time operation of the gate driver, a desired output signal can be generated only from a corresponding shift register, thereby enhancing the produce reliability.

Figure 11:
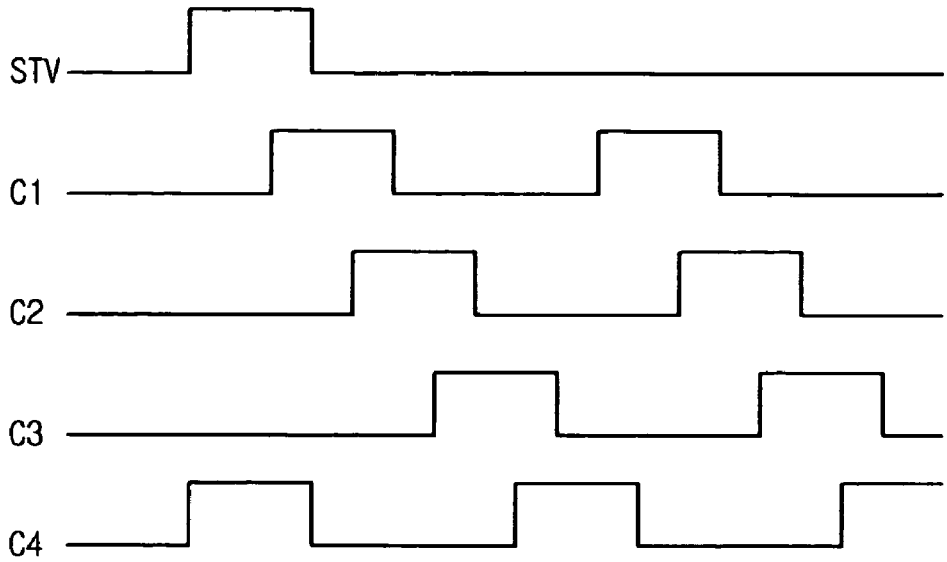
FIG. 11 is a waveform diagram of exemplary four-phase clocks signals with partially overlapping pulses according to another embodiment the present invention.

FIG. 11 is a waveform diagram of exemplary four-phase clocks signals with partially overlapping pulses according to another embodiment the present invention. Referring to FIG. 11, when the multiphase clocks include three or more phases, respective clocks may be generated such that their high-state pulses partially overlap one another. In case of the four-phase clocks, as illustrated in FIG. 11, the first and second clocks overlap each other, the second and third clocks overlap each other, and the third and fourth clocks overlap each other. The overlapped area between the clocks may be adjusted. In an embodiment, the clocks overlap each other by half a clock period. Then, the first and third clocks are synchronized with each other and the second and fourth clocks are synchronized with each other.

Figure 12:
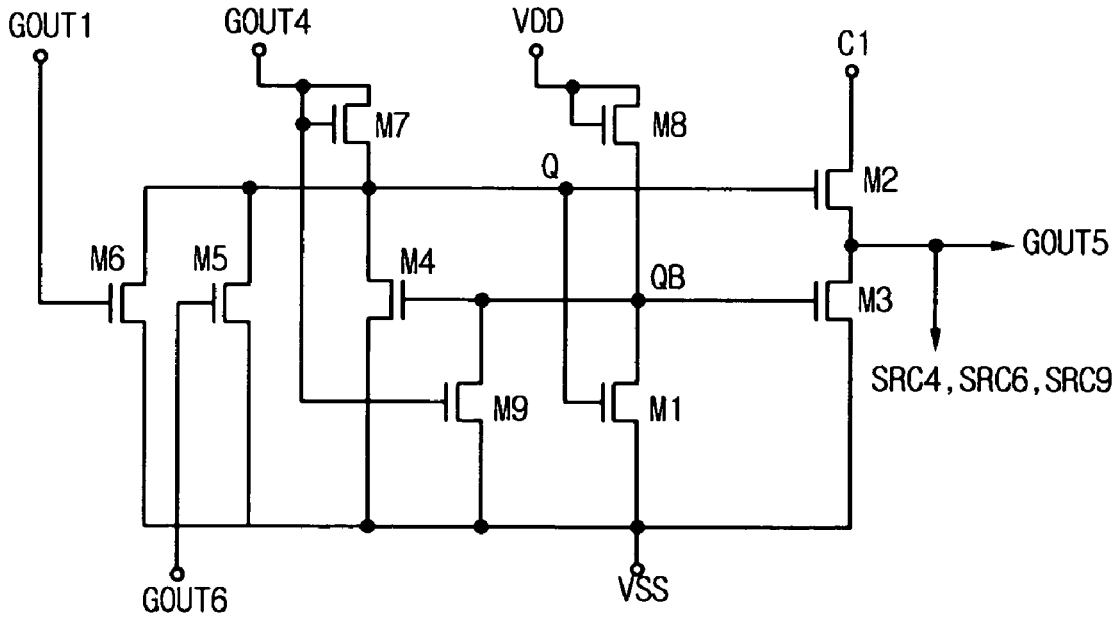
FIG. 12 is a circuit diagram of an exemplary shift register for the gate drivers according to an embodiment of the present invention.

FIG. 12 is a circuit diagram of an exemplary shift register for the gate drivers according to an embodiment of the present invention. As described above, the shift resisters of the gate driver have similar structure. For convenience of description, the fifth shift register SRC5 using the four-phase clocks is exemplarily illustrated in FIG. 12.

Referring to FIG. 12, the fifth shift register SRC5 includes second and third transistors M2 and M3 for controlling a fifth output signal GOUT5. The second transistor M2 includes a gate connected to a Q node, a drain connected to the first clock C1, and a source connected to the fifth output signal GOUT5. The third transistor M3 includes a gate connected to a QB node, a drain connected to the fifth output signal GOUT5, and a source connected to the first power supply voltage VSS. Accordingly, the second transistor M2 is switched on/off by the charge/discharge of the Q node, and the third transistor M3 is switched on/off by the charge/discharge of the QB node.

The Q node is charged by a fourth output signal GOUT4 of the fourth shift register SRC4. Also, the Q node is discharged by the first power supply voltage VSS that is supplied through a firth transistor M5 switched on by a sixth output signal GOUT6 of a sixth shift register SRC6 and through a fourth transistor M4 switched on by the QB node. The fifth transistor M5 includes a gate connected to an output signal GOUT6 of a sixth shift register SRC6, a drain connected to the Q node, and a source connected to the first power supply voltage VSS. The fourth transistor M4 includes a gate connected to the QB node, a drain connected to the Q node, and a source connected to the first power supply voltage VSS. When the fifth transistor M5 is turned on by the output signal GOUT6 of the sixth shift register SRC6, the Q node is discharged by the first power supply voltage VSS. When the QB node is charged with the second power supply voltage VDD, the fourth transistor M4 is turned on by the charged QB node and the Q node is discharged into the first power supply voltage VSS.

Also, the Q node can be discharged by the first power supply voltage VSS that is supplied through the sixth transistor M6 switched on by the first output signal GOUT1 of the first shift register SRC1. The sixth transistor M6 includes a gate connected to the first output signal GOUT1 of the first shift register SRC1, a drain connected to the Q node, and a source connected to the first power supply voltage VSS.

In an embodiment, the width of the sixth transistor M6 may be greater or smaller than the width of the fifth transistor M5. For example, the width of sixth transistor M6 may be 0.5~1.5 times the width of the fifth transistor M5.

The fifth shift register SRC5 to which the first clock C1 is applied is reset by the output signal GOUT9 that is outputted from the ninth shift register SRC9 enabled by the first clock C1. When the output signal GOUT9 is outputted from the shift register SRC9 following the fifth shift register SRC5 by the first clock C1, the fifth output signal GOUT5 can be prevented from being outputted from the fifth shift register SRC5, to which the first clock is also applied, due to the long-time operation of the gate driver. In this manner, since all the previous shift registers with respect to the current shift register are reset, the corresponding previous shift register does not output any output signal at the time when the current shift register outputs an output signal.

The QB node is charged by the second power supply voltage VDD, and is discharged by the first power supply voltage VSS that is supplied through the first transistor M1 switched on by the Q node. The first transistor M1 includes a gate connected to the Q node, a drain connected to the QB node, and a source connected to the first power supply voltage VSS. When the Q node is charged by the fourth output signal GOUT4 of the fourth shift register SRC4, the first transistor M1 is turned on by the charged fourth output signal GOUT4 to discharge the QB node by the first power supply voltage VSS.

Also, the QB node is discharged by the first power supply voltage VSS that is supplied through a ninth transistor M9 switched on by the fourth output signal GOUT4 of the fourth shift register SRC4. The ninth transistor M9 includes a gate connected to the fourth output signal GOUT4 of the fourth shift register SRC4, a drain connected to the QB node, and a source connected to the first power supply voltage VSS. The ninth transistor M9 is turned on by the fourth output signal GOUT4 of the fourth shift register SRC4 to discharge the QB node by the first power supply voltage VSS.

A seventh transistor M7 that includes a gate and a drain connected to the output signal GOUT4 of the fourth shift register SRC4 and a source connected commonly to the Q node may be provided so as to prevent a reverse current from flowing from the Q node to the output signal GOUT4 of the fourth shift register SRC4.

Also, an eighth transistor M8 that includes a gate and a drain connected commonly to the second power supply voltage VDD and a source connected to the QB node may be provided so as to prevent a reverse current from flowing from the QB node to the second power supply voltage VDD.

According to embodiments of the present invention, an output signal outputted by a predetermined multiphase clock can reset the next shift register, to which the predetermined clock is also applied. Accordingly, the output signal can be outputted only at a desired time.

As described above, the gate driver includes a plurality of shift registers, and the next shift resister to which a predetermined clock is applied is reset using an output signal that is outputted from the previous shift register by the predetermined clock. Accordingly, a plurality of output signals can be prevented from being simultaneously outputted from the shift registers to which the identical clock is applied. Therefore, a corresponding output signal can be outputted from the gate driver only at a desired time. Accordingly, a reliable output signal can be obtained. Thus, the malfunction of the gate driver can be prevented and the lifetime of the gate driver can be extended. Also, the screen flickering can be prevented, thus enhancing image quality.

It will be apparent to those skilled in the art that various modifications and variations can be made in gate driver and display device having the same of the present invention. Thus, it is intended that the present invention covers the modifications and variations of this invention provided they come within the scope of the appended claims and their equivalents.

What is claimed is:

1. A gate driver, comprising:

a plurality of shift registers connected in cascade to each other and driven by a plurality of multiphase clock, respectively, wherein the next shift register to which one of the plurality of multiphase clocks is applied is reset using an output signal outputted from the previous shift register in response to the one of the plurality of multiphase clocks, wherein the output signal of each shift register is inputted into a set terminal of the first next shift register, a reset terminal of the second next shift register and a reset terminal of the previous shift register, wherein the output signal of a current shift register sets the first next shift register and resets the second next shift register and the previous shift register.

2. The gate driver according to claim 1, wherein the plurality of shift registers include a number N of shift registers, each of the plurality of multiphase clocks includes a two-phase clock, and the (M+2)th shift register is reset by an output signal of the Mth shift register, where M is (N−2), and M and N are integers.

3. The gate driver according to claim 1, wherein the plurality of shift registers includes a number N of shift registers, each of the plurality of multiphase clocks includes a three-phase clock, and the (M+3)th shift register is reset by an output signal of the Mth shift register, where M is (N−3), and M and N are integers.

4. The gate driver according to claim 1, wherein the plurality of shift registers include a number N of shift registers, each of the plurality of multiphase clocks includes a four-phase clock, and the (M+4)th shift register is reset by an output signal of the Mth shift register, where M is (N−4), and M and N are integers.

5. The gate driver according to claim 1, wherein the plurality of shift registers include a number N of shift registers, each of the plurality of multiphase clocks includes a five-phase clock, and the (M+5)th shift register is reset by an output signal of the Mth shift register, where M is (N−5), and M and N are integers.

6. The gate driver according to claim 1, wherein the multiphase clocks partially overlap each other.

7. A display device, comprising:

a display panel in which pixels defined by gate lines and data lines are arranged in a matrix;

a data driver supplying image data to the data lines; and a gate driver supplying corresponding output signals to the gate lines, the gate driver including a plurality of shift registers connected in cascade to each other and driven by a plurality of multiphase clocks, respectively, wherein the next shift register to which one of the plurality of multiphase clocks is applied is reset using an output signal outputted from the previous shift register in response to the one of the plurality of multiphase clocks, wherein the output signal of each shift register is inputted into a set terminal of the first next shift register, a reset terminal of the second next shift register and a reset terminal of the previous shift register, wherein the output signal of a current shift register sets the first next shift register and resets the second next shift register and the previous shift register.

8. The display device according to claim 7, wherein the plurality of shift registers includes a number N of shift registers, each of the plurality of multiphase clocks includes a two-phase clock, and the (M+2)th shift register is reset by an output signal of the Mth shift register, where M is (N−2), and M and N are integers.

9. The display device according to claim 7, wherein the plurality of shift registers includes a number N of shift registers, each of the plurality of multiphase clocks includes a three-phase clock, and the (M+3)th shift register is reset by an output signal of the Mth shift register, where M is (N−3), and M and N are integers.

10. The display device according to claim 7, wherein the plurality of shift registers includes a number N of shift registers, each of the plurality of multiphase clocks includes a four-phase clock, and the (M+4)th shift register is reset by an output signal of the Mth shift register, where M is (N−4), and M and N are integers.

11. The display device according to claim 7, wherein the plurality of shift registers includes a number N of shift registers, each of the plurality of multiphase clocks includes a five-phase clock, and the (M+5)th shift register is reset by an output signal of the Mth shift register, where M is (N−5), and M and N are integers.

12. A method for driving gate lines in a display panel, comprising:

sequentially outputting a plurality of output signals, including first, second, third and fourth output signals through corresponding first, second, third and fourth shift registers, respectively;

setting the second shift register concurrently with outputting the first output signal; and setting the third shift register and resetting the first shift register and fourth shift register concurrently with outputting the second output signal, wherein the second output signal of the second shift register is inputted into a set terminal of the third shift register, a reset terminal of the fourth shift register and a reset terminal of the first shift register, wherein the second output signal of the second shift register sets the third shift register and resets the fourth shift register and the first shift register, wherein the sequentially outputting including sequentially outputting the first, second, third and fourth output signals.

13. The method of claim 12, wherein the sequentially outputting includes outputting an N-number of output signals through a corresponding N-number of shift registers driven by a plurality of two-phase clocks, including resetting the N-numbered shift register concurrently with outputting the (N−2)-numbered output, where N is an integer.

14. The method of claim 12, wherein the sequentially outputting includes outputting an N-number of output signals through a corresponding N-number of shift registers driven by a plurality of three-phase clocks, including resetting the N-numbered shift register concurrently with outputting the (N−3)-numbered output, where N is an integer.

15. The method of claim 12, wherein the sequentially outputting includes outputting an N-number of output signals through a corresponding N-number of shift registers driven by a plurality of four-phase clocks, including resetting the N-numbered shift register concurrently with outputting the (N−4)-numbered output, where N is an integer.

16. The method of claim 12, wherein the sequentially outputting includes outputting an N-number of output signals through a corresponding N-number of shift registers driven by a plurality of a K-number of clock phases, including resetting the N-numbered shift register concurrently with outputting the (N−K)-numbered output, where N and K are integers.

* * * * *